US007438334B2

(12) United States Patent
Terry et al.

(10) Patent No.: US 7,438,334 B2
(45) Date of Patent: Oct. 21, 2008

(54) BOLT-TYPE SEAL LOCK

(76) Inventors: Daniel J. Terry, P.O. Box 12279, Woodinville, WA (US) 98082-0279; Daniel Kenney, P.O. Box 12279, Woodinville, WA (US) 98082-0279

( * ) Notice: Subject to any disclaimer, the term of this patent is extended or adjusted under 35 U.S.C. 154(b) by 0 days.

(21) Appl. No.: 11/193,300

(22) Filed: Jul. 29, 2005

(65) Prior Publication Data

US 2007/0024066 A1 Feb. 1, 2007

(51) Int. Cl.
*E05B 39/02* (2006.01)

(52) U.S. Cl. ..... 292/327; 292/307; 340/572.1

(58) Field of Classification Search ..... 292/327, 292/307 A; 340/572.1, 572.7, 572.9
See application file for complete search history.

(56) References Cited

U.S. PATENT DOCUMENTS

| | | | | |
|---|---|---|---|---|
| 3,945,671 | A | 3/1976 | Gerlach | |
| 5,042,181 | A * | 8/1991 | Fortsch | 40/316 |
| 5,120,097 | A * | 6/1992 | Fattori et al. | 292/318 |
| 6,039,365 | A | 3/2000 | Rogatnev | |
| 6,069,563 | A * | 5/2000 | Kadner et al. | 340/571 |
| 6,265,973 | B1 * | 7/2001 | Brammall et al. | 340/568.1 |
| 6,331,022 | B1 | 12/2001 | Liroff | |
| 6,550,830 | B2 | 4/2003 | Kueznel | |
| 6,962,376 | B2 * | 11/2005 | Palzkill et al. | 292/327 |
| 7,042,354 | B2 * | 5/2006 | Auerbach et al. | 340/539.31 |
| 7,178,369 | B2 * | 2/2007 | Azzalin et al. | 70/50 |
| 2003/0189491 | A1 * | 10/2003 | Ng | 340/572.9 |

OTHER PUBLICATIONS

Website information from Brooks, www.brookseals.com—Jul. 7, 2005.

Website information from Leghorn SRL, www.securityseal.com Jul. 7, 2005.

Website information from American Casting, www.americancasting.com—Jul. 7, 2005.

Website information from Omni Security Consultants, Inc., www.sealock.com—Jul. 7, 2005.

Website information from ENVOSEAL, www.itw-envopak.com—Jul. 7, 2005.

Press release titled "Sealock Inducted Into ISMA"—JUl. 7, 2005.

Website information from Macsema, Inc., www.macsema.com—Jul. 7, 2005.

Website information from Stoffel Seals, www.stoffel.com—Jul. 7, 2005.

(Continued)

*Primary Examiner*—Gary Estremsky

(57) ABSTRACT

The invention is a bolt-type seal lock for use with shipping containers or similar kinds of applications where seal locks are needed. The seal includes a bolt and a separate locking body. The locking body holds a locking mechanism that engages with an end of the bolt when it is inserted into the locking body. The locking body houses a flash memory or equivalent electronic storage device that stores shipping or transportation data relating to the contents of the shipping container. The seal also has a locking mechanism that can be released by a special tool through a lateral access opening. The lateral opening is covered by an identification tab that serves as an identification mechanism for indicating seal tampering and as a barrier to access to the locking mechanism. The identification tab is replaceable which makes the seal recyclable and reusable by shipping companies having a need for large numbers of bolt-type seal locks.

6 Claims, 4 Drawing Sheets

OTHER PUBLICATIONS

Website press release from Savi Technology, Inc., titled "South Korean Govt. Selects Networked RFID and Software Solution from Savi Tech.", www.savi.com—Mar. 7, 2005.

Website information from Savi Technology, Inc., www.savi.com—Jul. 19, 2005.

* cited by examiner

BOLT-TYPE SEAL LOCK

TECHNICAL FIELD

The invention disclosed here relates to seal locks for shipping containers. More particularly, it relates to a bolt-type seal lock that has both rewritable data storage capability and an improved tamper-proof feature that makes the seal lock easy to recycle.

BACKGROUND OF THE INVENTION

Bolt-type container seals, or seal locks, have been used for many years to seal and lock cargo shipping containers. These seals were originally designed as a next-generation seal that followed earlier, and simpler, band-type seals. Seals indicate to the receiver of the container whether someone made unauthorized access to the container's contents. Bolt-type seals provide a higher level of security than a band seal because they are harder to break.

The construction of a typical bolt-type seal is very simple in that it primarily consists of a hardened steel bolt that is passed through latching or locking structure on a container door and then inserted into a locking member. The door locking structure is often nothing more than existing holes or slots in a shipping container door. The locking member part of the seal permanently engages with the bolt's end and therefore prevents retraction or removal of the bolt. The container is opened by using a bolt-cutter that destroys the bolt and, consequently, makes both the bolt and locking member unusable. For reference purposes, an example of this type of seal lock is illustrated in U.S. Pat. No. 3,945,671.

On the outside, the present invention looks similar to the type of seal lock described above. However, the present invention has design improvements that are intended to both save cost and improve the way shipping records are transported with containers.

First, it needs to be appreciated that large numbers of shipping containers are used on a world-wide basis. Major shippers like United Parcel Service (U.P.S.) currently purchase large quantities of bolt-type seals on an annual basis. While there may be some reusable bolt-type seals in use today, these seals are typically one-use only, as per the above description. The bolt is destroyed when it is cut and the locking mechanism is simply thrown away. For some shippers the annual cost attributable to seal lock purchases is significant because of the large numbers of containers that use seals of this kind. Therefore, the successful development of a bolt-type seal design that is reusable, or recyclable, presents an opportunity for significant cost savings.

Second, there is always supporting documentation that accompanies a container when it is shipped. This documentation generally includes manifest documents, shipping documents, and other kinds of documents relating to supply chain or tracking information. Anything that provides large shippers with a more efficient way of accessing or transmitting information of this kind is advantageous.

The invention disclosed here is designed to address both of the issues described above. The specific details and features of the invention are set forth below.

SUMMARY OF THE INVENTION

The invention is an improved bolt-type seal lock. Like conventional seal locks, the invention has a separate bolt and locking member (or locking body). The locking body has an opening for receiving an end of the bolt when it is inserted axially into the locking body. Received within the locking body is a locking mechanism for engaging with the bolt's end and holding it in place within the locking body.

One improvement that the invention provides is that the locking body includes, or houses, a rewritable electronic storage device. This device enables the storing of shipping data (i.e., information about a shipping container's contents, destination, etc.) that is carried with the seal lock. In situations involving use of the seal lock with a typical shipping container, the contents of the shipping container are inventoried as it is filled at the place of shipment. At that time, inventory data or related shipping information can be downloaded into the seal lock via a hand-held computing device. The data then travels with the seal lock and container to the destination point and is immediately available in electronic format when the container is emptied. The electronic storage device may be in the form of a flash memory that is housed within the locking body and accessed via a conventional universal serial bus (USB) port.

Another improvement provided by the invention relates to the function that seal locks normally provide, i.e., tamper indication and/or and security. In this instance, the invention provides this function in much the same way as conventional seal locks, but couples additional design features that make the seal lock reusable after the bolt is destroyed.

In the present invention, the locking body housing is designed to provide a lateral access point to the locking mechanism inside the housing—the latter mechanism providing the locking structure that engages with the end of the bolt. However, this access point, or lateral access opening, is covered by a metal identification (ID) tag that closes the access opening and impedes access to the locking mechanism. Removal or destruction of the metal tag enables access via an appropriate tool for releasing the end of the bolt after it is cut at the shipping container's destination point.

As mentioned above, the metal tag is an ID tag and bears an ID code that matches an ID code affixed to the shank of the bolt. Having matching ID codes on both the bolt and locking body is conventional in seal locks because the matching numbers further indicate that no tampering has occurred. ID codes also can be tracked as part of the shipping process.

When the seal lock arrives with the container at the destination point, the shipping or receiving person can easily see tampering, or lack of tampering, by inspection of the bolt, the ID codes printed on the bolt and the metal ID tag, or by the condition of the ID tag. In typical situations, the data stored in the locking body, via the electronic storage device described above, will be downloaded and the bolt cut via a conventional bolt cutter. When the bolt is cut, the end of the bolt remains engaged within the locking body. However, at that point the receiver returns the device to a facility for recycling.

Recycling is accomplished by removal of the ID tag or by drilling an opening through it to access the locking mechanism inside the locking body. A key or tool can then be inserted into the locking body via the exposed lateral access opening described above for manipulating the locking mechanism so that it releases the end of the cut-off bolt, thus allowing it to drop from the locking body. The ID tag is then replaced by a new one, thereby closing access to the locking mechanism once again. The new ID tag's code matches the code on a replacement bolt that is delivered to the shipper with the recycled locking body. The contents of the electronic data storage are erased for reuse.

When the locking device is returned to a shipper along with the replacement bolt, the shipper receives a used locking body having a replacement ID code on the metal tag. While the shipper or recycler pays for the replacement cost of bolts and ID tags, the recurring cost relating to replacement of the locking member portion of the seal is otherwise significantly reduced. The reader should bear in mind that, on conventional seal locks, unique ID codes are permanently affixed to both the bolt and locking body. This has made recycling difficult in the past, or impossible, because the locking body can not be reused due to the fact that it bears a unique serial number that is permanent or not erasable from the body's outer surface. The metal ID tag described above provides a way to both unlock the mechanism, without destroying the housing that holds it, and to rewrite ID codes on the locking body so that they match the ID code on replacement bolts. The only significant part that is destroyed during the recycling process is the ID tag and, of course, the bolt itself.

Further details of the invention as summarized above are disclosed in the following description which is to be taken in conjunction with the attached drawings.

BRIEF DESCRIPTION OF THE DRAWINGS

In the drawings, like reference numerals and letters refer to like parts throughout the various views, and wherein.

BEST MODE FOR CARRYING OUT THE INVENTION

Figure 1:
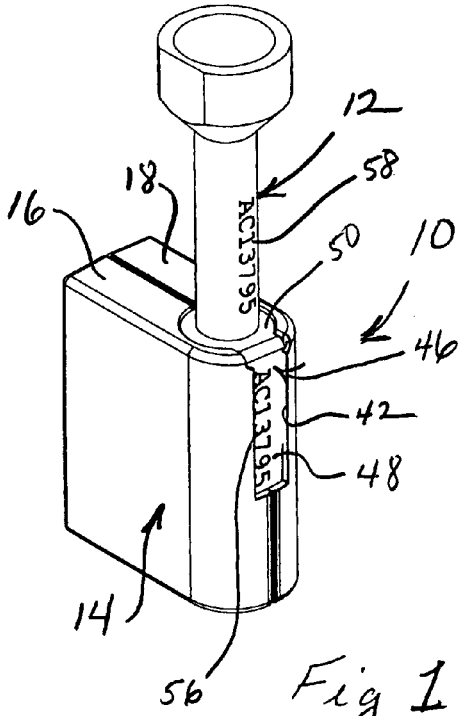
FIG. 1 is a pictorial view of a bolt-type seal lock constructed in accordance with the invention.

Referring now to the drawings, and first to FIG. 1, shown generally at 10 is a seal lock constructed in accordance with the present best mode for carrying out the invention. Like conventional seal locks, the lock 10 has a bolt 12 and a locking body 14. The bolt 12 is typical in construction. That is to say, it is a hardened bolt of the type already in use with similar seal locks. The locking body 14 has a housing made of two halves 16, 18 (see FIG. 2) that are permanently joined together.

Figure 2:
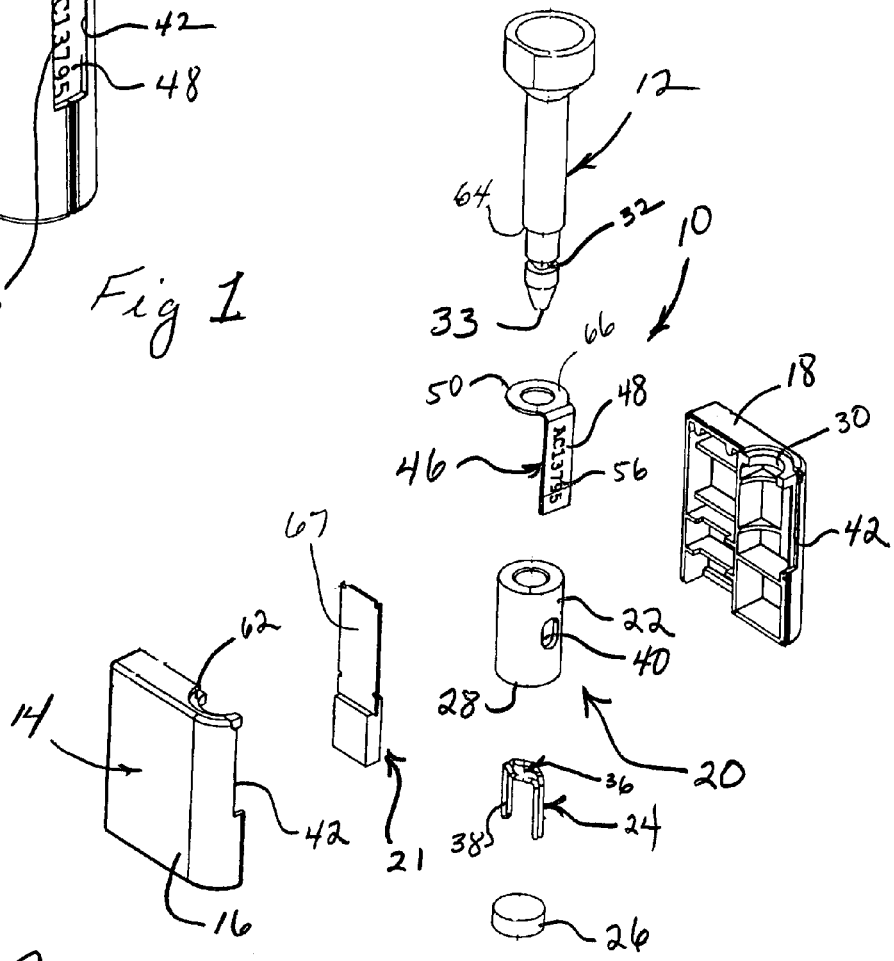
FIG. 2 is an exploded view of the seal lock shown in FIG. 1.

FIG. 2 illustrates the various components received or held within the locking body 14, including a locking mechanism, indicated generally at 20, and a rewritable data storage device, indicated generally at 21.

The components of the locking mechanism 20 include a cylinder or locking column 22 that holds a retaining spring or clip 24. The spring 24 is held in place inside the cylinder 22 by a plug 26 that is press-fit into an open end 28 of the cylinder. The arrangement of these parts is further illustrated in FIG. 3.

Figure 6:
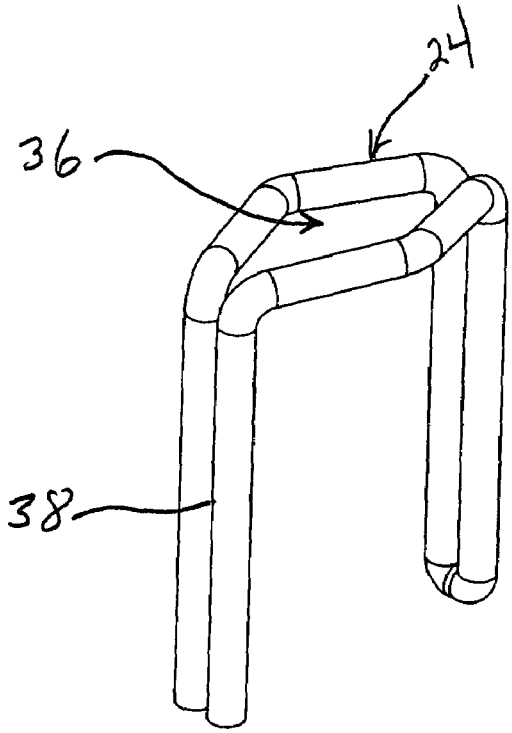
FIG. 6 is a pictorial view of a retention spring.

When the bolt 12 is inserted into the locking body 14, via an axial access opening indicated at 30, an annular or radial groove 32 in the bolt's end pushes through and spreads apart the spring 24. More specifically, and referring now to FIG. 6, when the bolt's tapered end 33 passes through the narrowed gap 36 defined by the spring 24, the spring rides up and over the bolt's end until it engages with groove 32, thereby locking the bolt into place. The end of the bolt 33 cannot be removed unless the spring 24 is spread apart by insertion of a tool into the spring at or about the point indicated at 38 in FIG. 6. The tool will cause spring gap 36 to widen sufficient to allow the bolt's end 33 to be removed. This mechanical operation is further described below.

Figure 5:
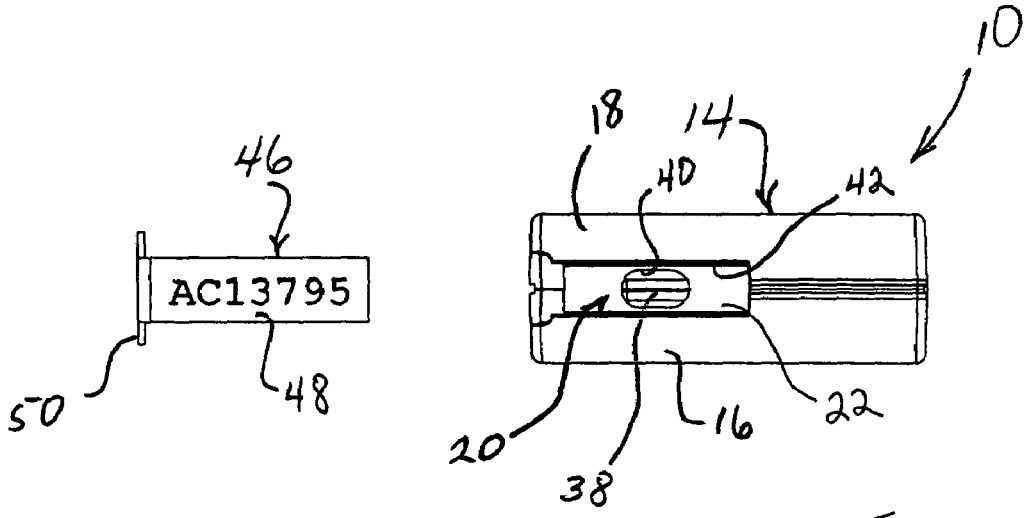
FIG. 5 is a pictorial view of a lateral side of the locking body, with an ID tag exploded from the locking body, to provide a view of the locking mechanism within the body.
Figure 7:
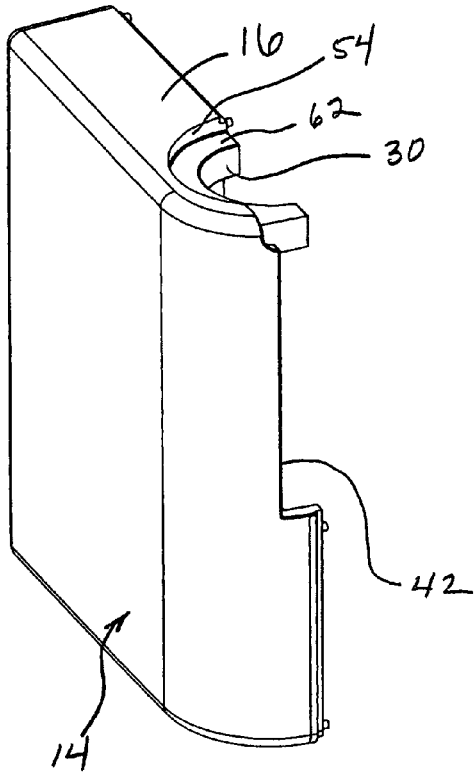
FIG. 7 is an exploded pictorial view of the locking body housing with contents removed.
Figure 7:
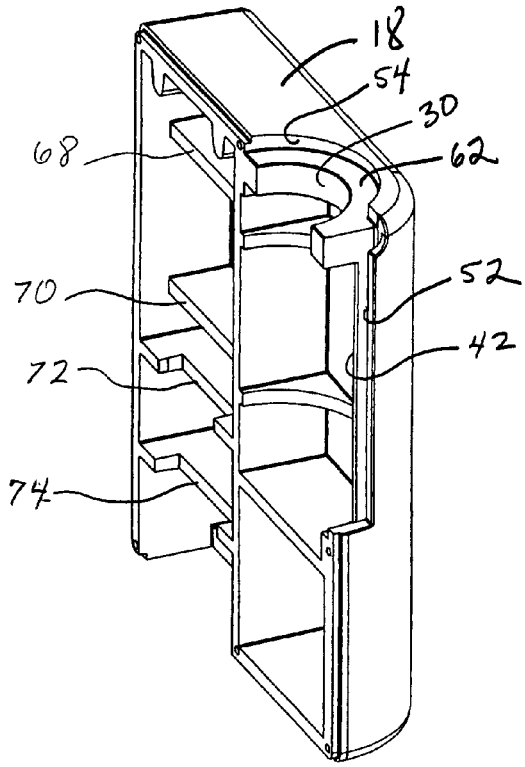

Lateral access to the spring 24 is provided via an access opening 40 in the side of the cylinder 22, which is best seen in the exploded view of FIG. 2. Referring to FIGS. 7 and 5, the locking body 14 has a lateral side opening (best illustrated at 42 in FIG. 7) that exposes the locking mechanism's cylinder 22 and the spring access opening 40. The cylinder 22 is held snugly in place within the locking body 14 by curved walls 44 that are molded in each half 16, 18 of the body when it is manufactured. The cylinder 22 is either keyed or appropriately bonded in place so that its spring access opening 40 will be exposed to view through the locking body's lateral side opening 42. This arrangement is best shown in FIG. 5.

The access opening 40 is covered or closed by a metallic ID tag, generally illustrated at 46. The ID tag 46 has one portion 48 that is shaped to cover or close opening or access point 42 in the locking body housing, and another portion, or ring portion 50, which surrounds the locking body's axial access opening 30 described above.

The metal ID tag 46 is semi-permanently slid into position after the locking body 14 is initially assembled and, of course, every time the locking body is recycled in the manner described here. Referring again to FIG. 7, the locking body housing 16, 18 has grooves on opposite sides 52 of the body's lateral access opening 42. These grooves allow the ID tag 46 to be slid into or out of place as indicated by arrow 60 in FIG. 5. The outer diameter of the ID tag's ring portion 50 is slightly less than the outer diameter of the annular recess in the locking body 14, which is indicated at 54 in FIG. 7. This allows the ring portion 50 of the ID tag to fit within the recess so that it rests directly against annular surface 62 that surrounds the bolt opening 30.

Figure 3:
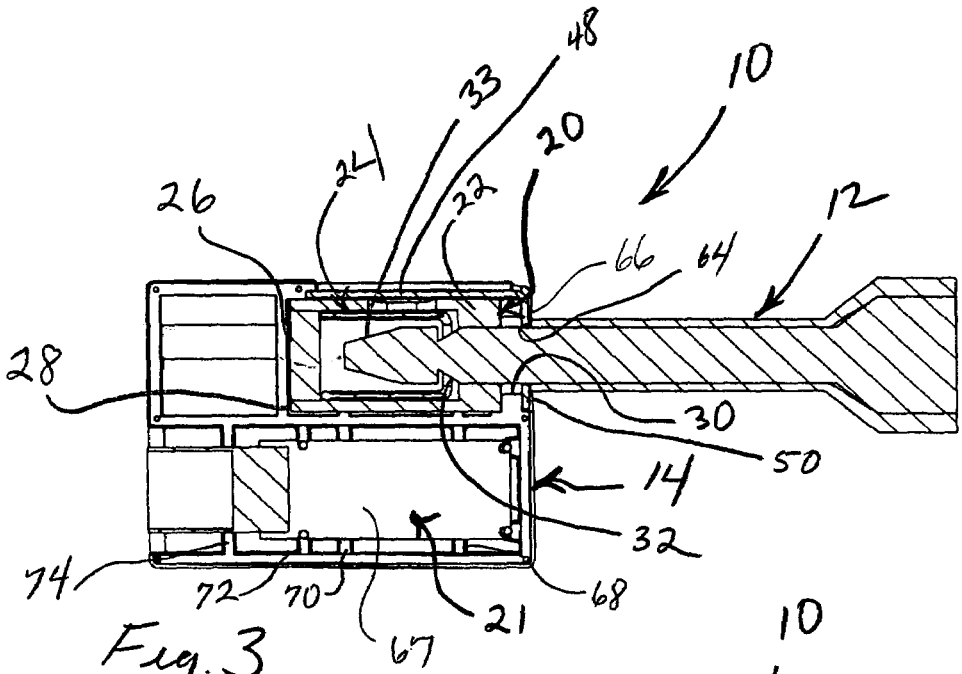
FIG. 3 is cross-sectional view of the seal lock shown in FIG. 1, taken along the axis of symmetry.

Before the bolt 12 is inserted into the locking body 14, the ID tag 46 (with an ID code 56 that matches an identical ID code 58 on the bolt 12) is slid into place on the locking body, as shown in FIG. 5. The bolt 12 is then inserted into the locking body 14 as shown in FIG. 3 and the other figures. The bolt 12 has an annular shoulder 64 that rests against the outer surface 66 on the ID tag's ring portion 50 when the bolt is inserted (See FIGS. 2 and 3). Thus, when the bolt 12 engages with the locking mechanism 20 inside the locking body the bolt holds the ID tag in place. The ID tag cannot be removed unless it is tampered with, or destroyed in some way, or the bolt is removed.

The ID code 56 is permanently printed on portion 48 of the ID tag 46. The ID code 58 on the bolt 12 is also permanently printed on it. This type of arrangement is typical in bolt-type seal locks. However, as mentioned above, in the typical seal lock there is no way to make the locking body part of the seal reusable, in part, because the code that is permanently printed on it cannot be easily reprinted to match the number of a new bolt after the previous one was destroyed. Of course, this feature alone was not the only one that makes recycling difficult. More fundamentally, the locking mechanism in typical seal locks could not be accessed without destroying the body of the locking member. The ID tag 46 solves both problems in that it provides a way to access the locking mechanism 21 (although the tag is destroyed in the process) and reprint ID codes on the locking body portion of the seal lock.

In the present invention, once the bolt 12 is cut in the usual way after installation on a container, the locking body can be returned to the manufacturer or another designated recycler.

The bolt 12 will be cut at a location aft of the bolt shoulder 64 that retains the ID tag 46 in place. As mentioned above, the ID tag is destroyed during the process of using a tool to access the retainer spring 24 inside locking mechanism cylinder 22 via the access opening 40 in the cylinder (once again, refer to FIG. 5). Once the spring 24 is spread apart by inserting the tool at 38 on the spring, the cut-offend of the bolt 12 can be pulled or will drop free from the locking body 14. At that point, the destroyed or used ID tag 46 can be easily slid from the locking body and replaced with a new one having a different ID code. The locking body 14 is then returned to a shipper with new ID tag installed and a separate bolt having an ID code that matches the one on the newly installed ID tag.

In addition to the mechanical components described above, the locking body 14 is sized to accommodate the rewritable data storage device 21 described above. The data storage device 21 is preferably a flash-memory type device that is similar to flash-memory devices sold to consumers for temporarily storing computer files. These devices are off the shelf components that are available from a number of sources. As illustrated in the drawings, the device is a rectangular electronics board 67 that carries the necessary data storage components. Each half 16, 18 of the locking body's housing 14 has surfaces 68, 70 between which the board 66 is sandwiched when the housing is assembled.

Figure 4:
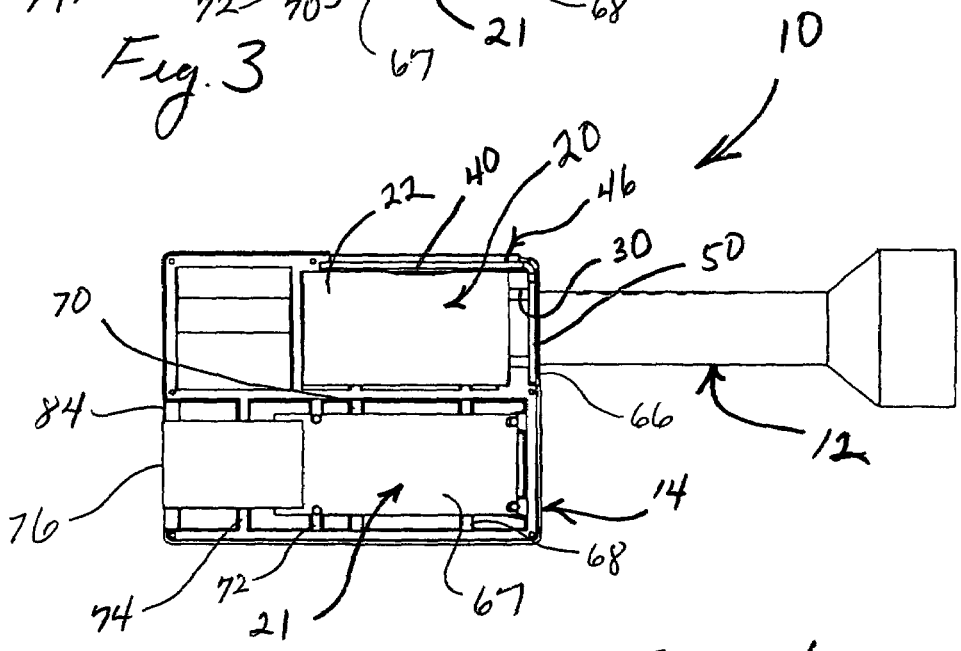
FIG. 4 is a side view of the seal lock shown in FIG. 1 with half of the locking body's cover removed.
Figure 8:
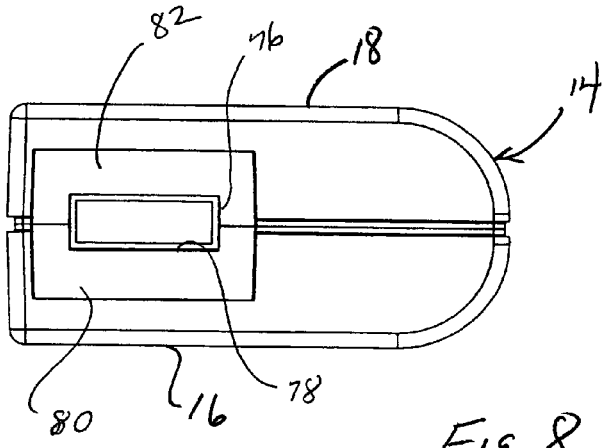
FIG. 8 is an end view of the locking body and shows a USB access port.

Attached to the board 66 is a conventional universal serial bus (USB) port 72 that is sandwiched between similar surfaces 72, 74 in the housing (see FIG. 7). The end 76 of the USB port 72 protrudes through a rectangular opening 78 that is defined by surfaces 80, 82 when housing halves 16, 18 are assembled together (see FIG. 8). The rectangular opening 78 is recessed slightly relative to the end of the locking body's outer surface, the location of which is indicated at 84 in FIG. 4. The end 76 of the USB port 72 is substantially flush with that outer surface 84. It may be covered with a rubber plug (not shown in the drawings) to keep the port clean and dry.

The data storage device 21 is powered via the other computing device (hand-held or otherwise for the purpose of downloading data stored in the lock seal 10) that is connected to it via cable to the USB port 72. No battery is needed. As mentioned above, the data storage device 21 is rewritable. Therefore, when the locking body 14 is returned for recycling, the device's memory may be erased so that new data may be written onto it by the shipper when the device 10 is returned to the shipper.

As indicated above, an advantage to the above design is that shipping or transportation data may be carried in the seal itself and not as a separate attachment to the shipping container. It is believed that this arrangement will provide related advantages to those shippers who rely on electronic tracking of shipped goods and it may eventually prove that the design described here has related applications that benefit others in the supply chain. Once again, another important advantage to the design disclosed here is that it provides a way to make seals reusable and thus can provide significant cost savings.

The foregoing description sets forth a single embodiment of the invention and is not necessarily intended to limit the scope of the patent right. It is conceivable that, as technology changes, certain components described above may be improved upon, or evolve, without departing from the spirit and scope of the invention and its advantages as described above. The scope of patent protection is not to be limited by the specifics of the foregoing description. Instead, the scope of the right is to be limited in accordance with the applicable doctrines relating to patent interpretation.

What is claimed is:

1. An improved bolt-type seal, comprising:

a bolt;

a locking body, the locking body having a locking mechanism within the locking body for engaging with the bolt, the locking body further having a first opening for axially receiving an end of the bolt and guiding the bolt into the locking mechanism, and a second lateral opening for providing access to the locking mechanism; and an identification tag having a portion shaped to cover the lateral opening in the locking body in a manner that impedes access to the locking mechanism; and wherein the identification tag also has a ring portion that is connected to the portion of the identification tag that is shaped to cover the lateral opening of the locking body, the ring portion surrounding the first opening of the locking body that axially receives the bolt, in a manner so that the bolt secures the identification tag in place when the bolt is engaged with the locking mechanism.

2. The seal of claim 1, wherein the bolt carries an identification code and the identification tag separately carries an identification code that matches the code on the bolt.

3. The seal of claim 1, wherein the bolt carries an identification code, and wherein the portion of the identification tab that covers the lateral opening in the locking body separately carries an identification code that matches the code on the bolt.

4. An improved bolt-type seal, comprising:

a bolt;

a locking body, the locking body having a locking mechanism within the locking body for engaging with the bolt, the locking body further having a first opening for axially receiving an end of the bolt and guiding the bolt into the locking mechanism, and a second opening for providing lateral access to the locking mechanism;

an identification tag having a portion shaped to cover the lateral access opening in the locking body in a manner that impedes access to the locking mechanism, and wherein the identification tag also has a ring portion that is connected to the portion of the identification tag that is shaped to cover the lateral opening of the locking body, the ring portion surrounding the first opening of the locking body that axially receives the bolt, in a manner so that the bolt secures the identification tag in place when the bolt is engaged with the locking mechanism; and a rewritable data storage device, also received within the locking body, for storing data electronically with the bolt-type seal.

5. The seal of claim 4, including a connecting port for connecting the data storage device to a computing device.

6. The seal of claim 4, wherein the data storage device is mounted on an electronics board having a USB connection, the USB connection being accessible to a separate computing device.

* * * * *